US006243552B1

(12) United States Patent
Murata

(10) Patent No.: US 6,243,552 B1
(45) Date of Patent: Jun. 5, 2001

(54) CHARGING MEMBER AND IMAGE FORMING APPARATUS USING THE SAME

(75) Inventor: Jun Murata, Kawagoe (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/361,845

(22) Filed: Jul. 27, 1999

(30) Foreign Application Priority Data

Jul. 29, 1998 (JP) ..... 10-214248

(51) Int. Cl.[7] ..... G03G 15/02
(52) U.S. Cl. ..... 399/176
(58) Field of Search ..... 399/174, 176

(56) References Cited

U.S. PATENT DOCUMENTS 5,378,526 1/1995 Murata ..... 128/214
5,625,858 * 4/1997 Hirai et al. ..... 399/176
5,742,860 * 4/1998 Takenaka et al. ..... 399/176
5,751,801 * 5/1998 Murata et al. ..... 399/176
5,761,581 * 6/1998 Nojima ..... 399/174

FOREIGN PATENT DOCUMENTS 7-164571 6/1995 (JP) .
9-114189 * 5/1997 (JP) ..... 399/176
9-127760 * 5/1997 (JP) ..... 399/176

* cited by examiner

*Primary Examiner*—Fred L. Braun
(74) *Attorney, Agent, or Firm*—Fitzpatrick, Cella, Harper & Scinto

(57) ABSTRACT

A charging member is provided for charging a member to be charged, which exhibits less nonuniformity in resistance, uniform chargeability and excellent processability, which is non-adhesive and thus causes neither adhesion to nor contamination of a photosensitive member, and which causes less residual strain with excellent durabiltiy even in long-term pressure contact, and an electrophotographic apparatus using the charging member. The charging member is composed of a conductive elastomer formed by vulcanizing a rubber composition containing nitrile rubber having a cross-linked polybutadiene structure in its molecule.

13 Claims, 3 Drawing Sheets

CHARGING MEMBER AND IMAGE FORMING APPARATUS USING THE SAME

BACKGROUND OF THE INVENTION

1. Field of the Invention

The present invention relates to a charging member used for an electrophotographic apparatus, etc., and particularly to a charging member for charging, transfer, and the like to which a voltage is applied to charge the surface of a member to be charged, and an image forming apparatus using the charging member, such as an electrophotographic apparatus, or the like.

2. Description of the Related Art

In an image forming apparatus such as an electrophotographlc apparatus (a copying machine, an optical printer, or the like), an electrostatic recording apparatus, or the like, a corona charger is used as a device for charging the surface of an image supporting member as a member to be charged, such as a photosensitive member, a dielectric member, or the like.

The corona discharger is effective as means for uniformly charging the surface of the member to be charged, such as an image supporting member or the like, to a predetermined potential. However, the corona discharger requires a high-voltage power source for corona discharge, and thus produces undesirable ozone.

In contrast to the corona discharger, a contact charger comprising a charging member to which a voltage is applied is brought near or in contact with the member to be charged to charge the surface of the member to be charged, permitting an attempt to decrease the voltage, and causing the advantage of generating less ozone.

Such a charging member requires low conductivity for obtaining uniformity in the member to be charged, such as a photosensitive member or the like, and for preventing leaks due to pinholes, flaws, etc. in the surface of the member to be charged.

For example, a transfer roller used in an image forming apparatus such as a copying machine or the like is a member for transferring, to transfer paper, a toner image on the image supporting member such as the photosensitive member, an intermediate transfer member, a transfer drum, or the like. When the transfer roller is brought into pressure contact with the photosensitive member for developing the toner image through the transfer paper as a material to be charged, a charge with polarity opposite to the toner of the toner image is supplied to transfer the toner image on the photosensitive member to the transfer paper by adsorption. However, the density of the charge supplied to the transfer paper significantly affects image quality.

Namely, with a low charge density, toner adsorptivity is weak, and particularly, black spots around a line image occur on dry paper. With a high charge density, bleeding occurs due to reverse polarity charging of the toner, and a high quality image cannot be obtained.

A nonuniform charge density, density nonuniformity occurs during transfer of a solid black image, or spot-shaped transfer nonuniformity such as a sand-like ground or the like occurs. Therefore, the surface of the transfer roller preferably has uniform conductivity.

In order to satisfy this requirement, a rubber roller is used, in which conductive particles of carbon black, graphite, a metal oxide such as titanium oxide, silver oxide, or the like, a metal such as Cu, Ag, or the like, or particles, which are made conductive by coating the surfaces of these particles, are mixed and dispersed on a conductive core material made of a metal or the like.

However, the resistance of the rubber roller comprising the dispersed conductive particles is difficult to control the results in variations in local resistance due to nonuniform dispersion of the conductive particles, causing charging nonuniformity or breakage of the photosensitive member due to partial leaks.

On the other hand, a method of obtaining conductivity is proposed, which uses NBR (acrylonitrile butadiene rubber) or hydrin rubber. Particularly, this method is capable of obtaining good uniform conductivity without a conductive additive. However, such a polar polymer contains a crystalline portion in its molecule, and thus produces significant permanent deformation due to its fluidity, causing deformation of the contact portion of the roller after standing for a long period of time. This causes an image defect due to an excessive current from the nip portion, and nonuniformity in carrying a transfer material such as paper or the like to cause nonuniformity in an image.

Namely, NBR and hydrin rubber contain cyano groups containing chlorine with high polarity. Therefore, polymer chains are attracted to each other through such polar groups to form the crystalline portion having a structure in which the polymer chains are regularly arranged. In the crystalline portion, the polymer chains are not cross-linked. In the amorphous portion, the polymer chains are cross-linked, and even if it is deformed by external force, it returns to the initial shape by releasing the external force. However, in the crystalline portion, the polymer chains are not cross-linked, and thus cannot be return to the initial shape, readily causing permanent deformation. Therefore, when a charging roller made of rubber having such polar groups is used as a transfer charging roller, and when the charging roller is brought into contact with a photosensitive drum which is not rotated for a long time, the contact portion of the charging roller is deformed, and the width of the nip between the charging roller and the photosensitive drum is increased, causing an excessive current to flow between the charging roller and transfer paper. As a result, the surface of the photosensitive drum is charged, and toner adheres to the charged surface during development to cause image nonuniformity.

In the deformed portion of the charging roller, the conveyance speed of the transfer paper is changed, causing nonuniformity in an image.

A polymer having high polarity, such as NBR or the like, has high adhesion, and thus adheres or sticks to the member to be charged, such as the photosensitive member or the like, when allowed to stand in contact with the member to be charged for a long period of time. This causes the problems of transferring the components of the charging member onto the member to be charged, and stopping rotation of the roller due to adhesion of the polymer.

SUMMARY OF THE INVENTION

The present invention has been achieved in consideration of the above problems, and an object of the invention is to provide a charging member which has less nonuniformity in resistance and uniform chargeability, and which is non-adhesive and thus causes neither adhesion to nor contamination of a photosensitive member in a long-term contact with a photosensitive member, with less residual strain and excellent durability.

Another object of the present invention is to provide an image forming apparatus comprising the charging member.

A further object of the present invention is to provide a process cartridge comprising the charging member.

In order to achieve the objects, the present invention provides a charging member to which a voltage is applied to charge the surface of a member to be charged, comprising a conductive elastomer composed of a vulcanized rubber composition containing nitrile rubber having a cross-linked polybutadiene structure in its molecule.

An image forming apparatus of the present invention comprises a charging member, wherein the charging member is the above-described charging member.

A process cartridge of the present invention comprises at least one of development means and cleaning means which is integrated with a photosensitive member and charging means to form a cartridge which is detachably mounted to the body of an image forming apparatus, wherein the charging member is the above-described charging member.

In the charging member of the present invention, nitrile rubber used for forming the conductive elastomer has a cross-linked polybutadiene structure in its molecule. The charging member of the present invention causes less permanent deformation and thus causes no image nonuniformity. The charging member is also non-adhesive and thus causes neither adhesion to nor contamination of the surface of the photosensitive member.

Such performance of the charging member of the present invention is possibly due to the fact that the three-dimensional structure of the cross-linked butadiene structure can prevent the formation of the above-mentioned crystalline portion due to polar cyano groups. Namely, it is thought that the cross-linked polybutadiene structure prevents regular arrangement of the polymer chains of nitrile rubber through cyano groups. It is also thought that the cross-linked butadiene structurally suppresses adhesion due to the cyano groups of the nitrile rubber, making the charging member non-adhesive.

Further objects, features and advantages of the present invention will become apparent from the following description of the preferred embodiments with reference to the attached drawings.

DESCRIPTION OF THE PREFERRED EMBODIMENT

Figure 1:
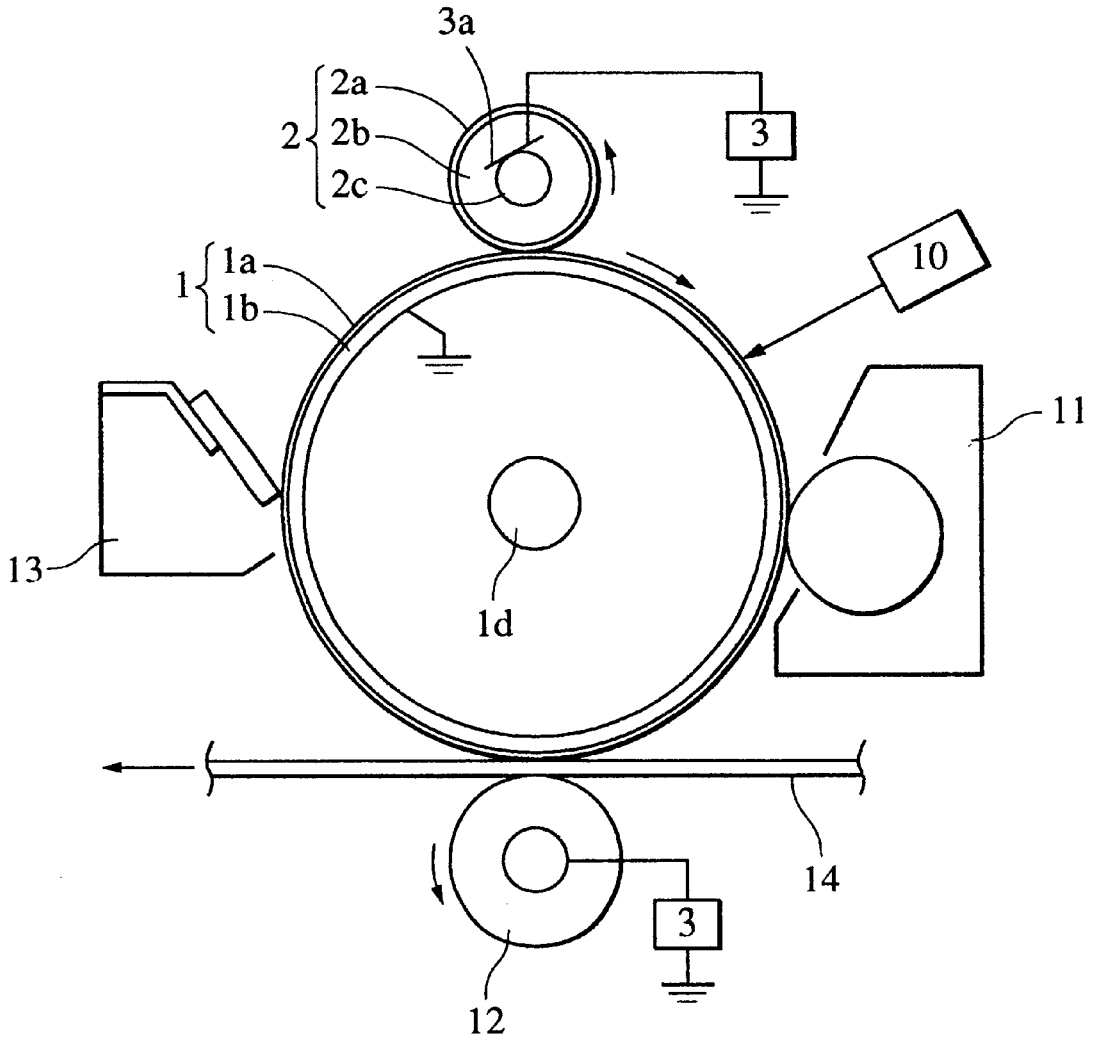
FIG. 1 is a schematic drawing showing the construction of an electrophotographic apparatus comprising a charging member of the present invention.

As the cross-linked polybutadiene structure of nitrile rubber contained in a rubber composition used for forming a conductive elastomer of a charging member of the present invention, polybutadiene cross-linked with a polyfunctional monomer is preferred.

The rubber composition preferably further contains nitrile rubber other than the nitrile rubber having the cross-linked polybutadiene structure in its molecule.

The rubber composition preferably comprises 10 to 50 parts by weight of nitrile rubber having the cross-linked polybutadiene structure in its molecule, 20 to 70 parts by weight of other nitrile rubber, and 10 to 50 parts by weight of nonpolar polymer.

Preferred examples of the rubber composition used for producing the charging member of the present invention will be described in further detail below.

As the cross-linked polybutadiene, two-dimensional or three-dimensional structure polybutadiene cross-linked with a polyfunctional monomer such as divinyl benzene, trivinyl benzene, ethylene glycol dimethacrylate, or the like is used.

Examples of the other nitrile rubber include NBR (acrylonitrile-butadiene rubber), hydrogenated NBR in which double bonds of butadiene are selectively hydrogenated, NBR in which carboxyl groups are introduced into the side chains of a three-dimensional copolymer of methacrylic acid and acrylic acid, NBIR and NIR in which butadiene is partially or entirely substituted, NBR copolymerized with an antioxidant, NBR in which butadiene is partially substituted by acrylate, and the like.

The rubber composition further contains a nonpolar polymer to make the formed elastomer further non-adhesive.

The nonpolar polymer is a polymer not having large bipolar moment in its molecule, and is generally a polymer having a low dielectric constant.

Examples of such a nonpolar polymer include NR (IR: isoprene rubber), BR (butadiene rubber), SBR (styrene butadiene rubber), EPDM (ethylene propylene diene terpolymer), IIR (butyl rubber), olefin elastomers, SEBS (styrene ethylene butadiene styrene) elastomers, polystyrene elastomers, and the like. A blend of these polymers can be adjusted to high resistance, and can comply with various resistance specifications of electrophotographic apparatus.

Particularly, when weather resistance such as ozone resistance is a problem, and when aging resistance is taken into account, EPDM is preferably used from the viewpoint of its high weather resistance. Particularly, for sulfur vulcanization, EPDM preferably has an iodine value (measurement by the Wijs method) of 20 or more, more preferably 30 or more, from the viewpoint of a covulcanization property.

Although hydrin rubber has good conductivity, a sufficient non-adhesive effect cannot be obtained even by such a blend with a nonpolar polymer as disclosed in Japanese Patent Laid-Open No. 7-164571 because of its high adhesion. However, a non-adhesive elastomer can be formed by combining hydrin rubber and nitrile rubber having the cross-linked butadiene structure.

Since hydrin rubber has no double bond, the quality is less changed by application of a voltage. Hydrin rubber also has the property that less deterioration occurs due to oxygen and ozone, and thus stability due to high durability can be expected.

Epichlorohydrin rubber generally comprises a copolymer of ethylene oxide, epichlorohydrin, propylene oxide, allyl glycidyl ether, etc. However, an epichlorohydrin homopolymer is most effective for changes in durability resistance.

This because the structure contains no double bond, and that oxidizing gases such as oxygen and the like permeate less into the molecule because of low gas permeability.

Therefore, durability can be improved by partially substituting the nitrile rubber with epichlorohydrin homopolymer.

A blend of these polymers is preferably obtained by mixing 20 to 70 parts by weight of the other nitrile rubber, 10 to 50 parts by weight of nitrile rubber having a cross-linked structure in a part of polybutadiene, 10 to 50 parts by weight of nonpolar polymer, and 10 to 40 parts by weight of epichlorohydrin homopolymer.

Namely, the amount of the nonpolar polymer is preferably 10 parts by weight or more from the viewpoint of further improvement in nonadhesiveness of the charging member to the photosensitive member or the like, and 50 parts by weight or less from the viewpoint of good conductivity of the charging member.

The amount of nitrile rubber having a cross-linked structure in a part of polybutadiene is preferably 10 parts by weight or more from the viewpoint of prevention of permanent deformation, and 50 parts by weight or less from the viewpoint of compatibility with other polymers, processability and strength, etc.

The nitrile content of the other nitrile rubber is preferably 45% by weight or less from the viewpoint of nonadhesiveness of the charging member, and 15% by weight or less from the viewpoint of conductivity.

The present invention will be described in further detail below with reference to the drawings.

Figure 3:
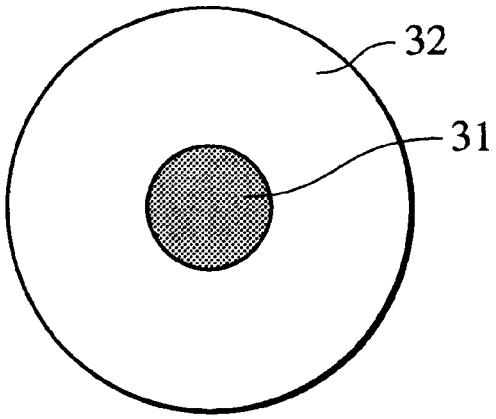
FIG. 3 is a schematic sectional view showing an example of the construction of a charging member of the present invention.

FIG. 3 is a schematic sectional view showing the construction of a transfer roller in accordance with an embodiment of the present invention. The transfer roller of this embodiment comprises a conductive cylindrical substrate 31 made of a metal, and a conductive elastic layer 32 provided on the substrate 31.

The conductive elastic layer 32 may have a level of electric resistance, which permits application of a transfer bias voltage to paper, and uniform contact with paper, and preferably has a volume resistance value of about $1\times10^5$ to $1\times10^{12}\Omega$.

The conductive elastic layer 32 preferably has low hardness in order to obtain a sufficient nip width with the member to be charged and attain uniform charging, and particularly, in the case of a transfer member, low hardness is preferred as a measure against "center missing" in which the central portion of an image is missing. Particularly, liquid NBR is effective for low hardness. Namely, liquid NBR has the same molecular structure as nitrile rubber and thus has excellent compatibility with nitrile rubber and non-transfer property. Liquid NBR can also achieve low hardness regardless of the resistance value. The low hardness is preferably 20° to 80° in terms of sponge hardness (asker C). The type of the rubber used may be either a solid or a foam.

Although adhesion to the member to be charged, such as the photosensitive member or the like, is improved by blending with the nonpolar polymer, a way to further improve adhesion is to modify the surface.

Examples of possible surface modifications include surface treatment with a blend of releasing particles such as silicone particles, fluororesin particles, and the like, a coupling agent, or a reactive fluorine surfactant, surface washing with a chlorinated solvent such as diluted hydrochloric acid or the like.

However, UV (ultraviolet rays) irradiation is preferred from the viewpoint of easiness and effectiveness of processing. Namely, UV irradiation is preferably used because it oxidizes the rubber surface, and makes the surface nonadhesive by a cross-linking reaction between diene bonds, and it has the smaller effect on physical properties as compared with additives, coating, etc. Preferable UV irradiation conditions include an irradiation strength of 10 to 100 mW/cm$^2$.

In the roller-shaped charging member, UV irradiation is performed under rotation of the roller to uniformly irradiate the entire surface with ultraviolet rays, thereby effectively processing the surface within a short time.

This processing also results in high releasability of the surface of the charging member, and thus permits easy cleaning of excessive toner and paper dust particles which adhere to the surface.

It is also effective to cure the surface by heat treatment.

Even when a functional layer such as a releasing layer or the like is provided on the surface layer according to demand, it is effective to use the elastic material of the present invention as a base layer.

FIG. 1 is a cross-sectional view showing the schematic construction of an electrophotographic apparatus using the charging member of the present invention. A drum-like electrophotographic photosensitive member 1 is an image supporting member as a member to be charged, comprising a conductive substrate layer 1*b* made of aluminum or the like, and a photoconductive layer 1*a* formed on the outer periphery of the substrate layer 1*b*. The electrophotographic photosensitive member 1 is rotated around a spindle 1*d* at a predetermined peripheral speed in the clockwise direction shown in the drawing.

A charging member 2 is brought into contact with the surface of the photosensitive member 1 primarily to uniformly charge the surface of the photosensitive member 1 to a predetermined polarity and potential, and is required to have uniform conductivity. The charging member 2 is a roller type, i.e., a charging roller. As described above, the charging roller 2 comprises a core bar 2*c*, a lower conductive elastic layer 2*b* formed on the outer periphery of the core bar 2*c*, and an upper resistance layer 2*a* formed on the outer periphery of the conductive elastic layer 2*b*, both ends of the core bar 2*c* being driven by pressure means (not shown) with rotation of the photosensitive member 1. The material of the present invention is effectively used for the resistance layer 2*a* and the conductive elastic layer 2*b*.

In this apparatus, a predetermined direct current (DC) bias or direct current/alternating current (DC+AC) bias is applied to the core bar 2*c* by a sliding power source 3*a* of a power source 3 to charge the peripheral surface of the rotating photosensitive member 1 to the predetermined polarity and potential in contact with the charging roller 2. The surface of the photosensitive member 1 uniformly charged by the charging member 2 is then subjected to exposure (laser beam scanning exposure, slit exposure of an original image, or the like) to target image information by exposure means 10 to form an electrostaic latent image on the peripheral surface according to the image information.

The latent image is successively visualized by the development means 11 to form a toner image. The toner image is then successively transferred, by transfer means 12, to the surface of a transfer material 14 which is carried between the photosensitive member 1 and the transfer means 12 from paper feed means (not shown) with appropriate timing to coincide with the rotational period of the photosensitive member 1.

In this embodiment, the transfer means 12 comprises a transfer roller which charges the transfer material 14 from the back thereof with the polarity opposite to the toner to transfer the toner image on the photosensitive member 1 to the surface side of the transfer material 14.

The transfer material 14 to which the toner image is transferred is separated from the surface of the photosensitive member 1, carried to image fixing means (not shown)

for fixing the image, and then output as an image-formed material. Alternatively, when an image is also formed on the back, the transfer material 14 is carried to means for re-carrying to the transfer unit. After the transfer of the image, adhered contaminants such as the toner remaining on the surface of the photosensitive member 1 after transfer are removed by the cleaning means 13 to form a clean surface which is repeatedly used for image formation.

Besides the roller type charging member provided the as means for charging the image supporting member 1 of the image forming apparatus shown in FIG. 1, the charging member 2 can be a blade type, a block type, a belt type, or the like.

The roller-type charging member 2 may be driven or not rotated by the member 1 to be charged, whose surface is moved, or positively rotated thereby at a predetermined peripheral speed in the direction of the surface movement of the member 1 to be charged or in the opposite direction. The charging member of the present invention is used as the charging member 2 and/or the transfer means 12.

As the electrophotographic apparatus, a plurality of components such as the photosensitive member, the development means, the cleaning means, etc. may be integrally combined to form a process cartridge which may be detachably mounted to the body of an image forming apparatus, such as a copying machine, a laser beam printer, or the like.

For example, at least one of the charging means, the development means, and the cleaning means may be integrally supported with the photosensitive member and the charging means to form a process cartridge which is detachable from the apparatus body by using guide means such as a rail or the like in the image forming apparatus. In this case, the process cartridge may be provided with the charging means and/or the development means.

In the use of the electrophotographic apparatus as a copying machine printer, image exposure is performed by laser beam scanning, driving a LED array or a liquid crystal shutter array, or the like using light reflected from or transmitted through an original or signals obtained by reading the original.

Figure 2:
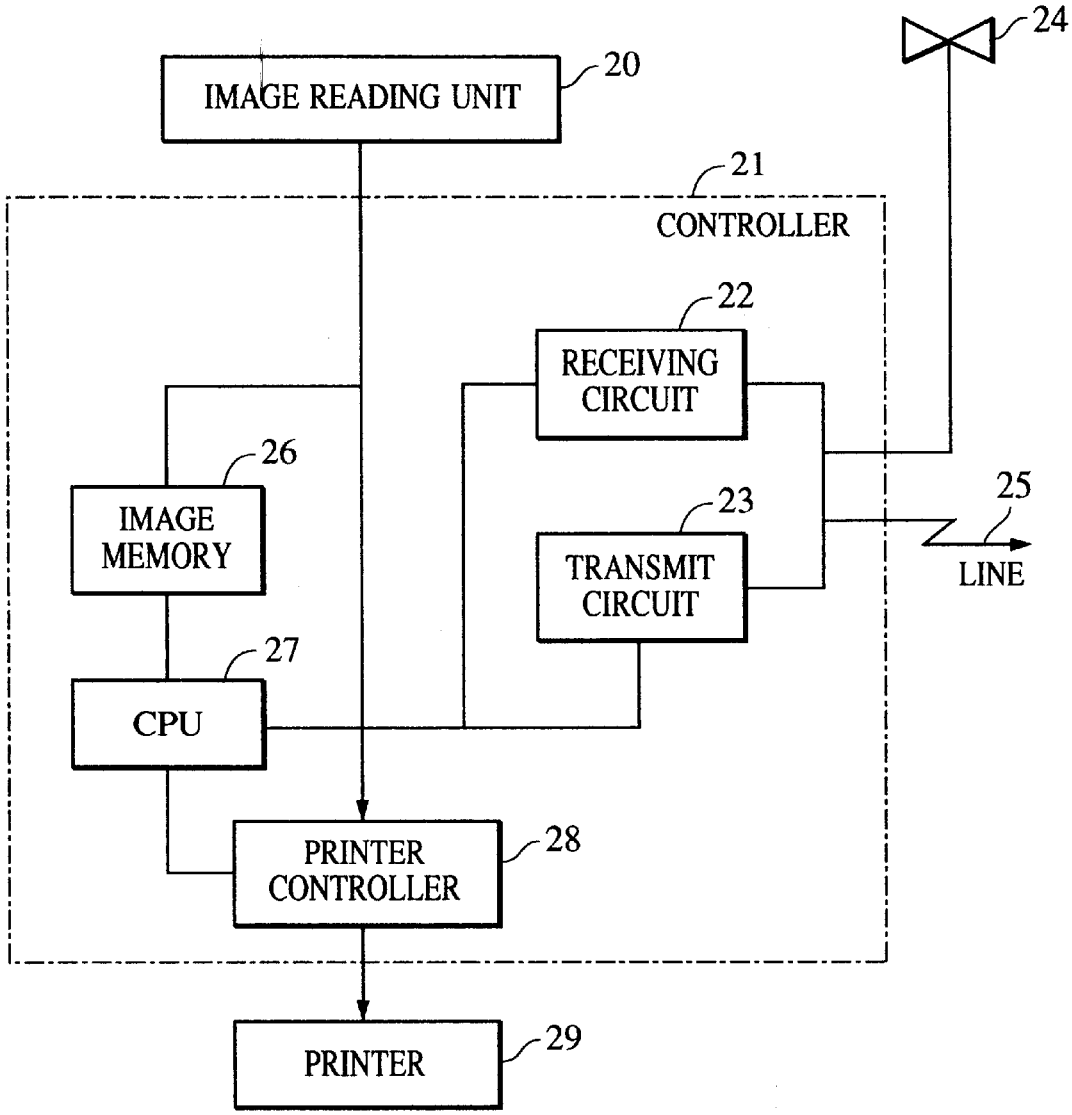
FIG. 2 is a block diagram showing the outline of a facsimile apparatus using, as a printer, an electrophotographic apparatus comprising a charging member of the present invention.

In use as a facsimile printer, image exposure is performed for printing received data. FIG. 2 is a block diagram showing an example of this case. A controller 21 controls an image reading unit 20 and a printer 29, and is controlled by CPU 27. The read data from the image reading unit 20 is transmitted to the printer 29 through a transmit circuit 23. An image memory stores predetermined image data. A printer controller 28 controls the printer 29. Reference numeral 24 denotes a telephone.

An image (image information from a remote terminal connected through a line) received from a line 25 is demodulated by a receiving circuit 22, and then the image information is subjected to composite processing by the CPU 27 to be successively stored in the memory 26. When an image of at least one page is stored in the memory 26, the image of the page is recorded.

The CPU 27 reads image information of one page from the memory 26, and transmits the composite image information of one page to the printer controller 28. When the printer controller 28 receives the image information of one page from the CPU 27, the printer controller 28 controls the printer 29 to record the image information of that page. During recording by the printer 29, the CPU 27 receives information of the next page. An image is received and recorded as described above.

The photosensitive layer is provided on a conductive support member. The conductive support member preferably has conductivity by itself, and for example, a metal such as aluminum, an aluminum alloy, stainless steel, nickel or the like can be used. Besides these metals, plastics, glass and the like which have a layer formed by vapor deposition coating of aluminum, an aluminum alloy, an indium oxide-tin oxide alloy, or the like can also be used.

An undercoat layer having both the barrier function and the adhesive function can also be provided between the conductive support member and the photosensitive layer.

The undercoat layer can be formed by using casein, polyvinyl alcohol, nitrocellulose, an ethylene-acrylic acid copolymer, an amide (nylon 6, nylon 66, nylon 610, nylon copolymer, or the like), polyurethane, gelatin, aluminum oxide, or the like.

The thickness of the undercoat layer is 5 $\mu$m or less, preferably 0.5 to 3 $\mu$m. In order to exhibit the functions, the undercoat layer preferably has an electric resistance value of $1\times10^7\Omega\cdot$cm or more.

The photosensitive layer can be formed by coating or depositing an organic or inorganic photoconductor, and if required, a binder resin. The type of the photosensitive layer is preferably a function separation-type photosensitive layer comprising a charge generation layer and a charge transport layer.

The charge generation layer can be formed by depositing a charge generation material such as an azo dye, a phthalocyanine dye, a quinone dye, or the like, or coating the charge generation material together with an appropriate binder resin (the binder may be omitted).

The thickness of the charge generation layer is 0.01 to 30 $\mu$m, preferably 0.05 to 2 $\mu$m.

The charge transport layer can be formed by dissolving a charge transport material such as a hydrazone compound, a styryl compound, an oxazole compound, a triarylamine compound, or the like in a binder resin having the film forming ability. The thickness of the charge transport layer is 5 to 50 $\mu$m, preferably 10 to 30 $\mu$m.

In order to prevent ultraviolet aging and improve abrasion resistance, a protecting layer may be provided on the photosensitive layer.

EXAMPLES

Although the present invention will be described in detail below with reference to examples, the present invention is not limited to these examples.

Example 1

FIG. 3 is a schematic sectional view showing the transfer roller of the present invention, which comprises the conductive elastic layer 32, and the conductive cylindrical substrate 31. The transfer roller comprises a semiconductive elastic roller provided on a conductive core bar having a diameter of 6 mm and made of stainless steel, iron, or iron with a rust-proof surface plated with nickel or nickel-chromium.

As elastomer materials, 30 parts by weight of EPT4070 (trade name, produced by Mitsui Petrochemical Co., Ltd., iodine value 22) as EPDM, 50 parts by weight of N230S (trade name, produced by Nippon Synthetic Rubber Co., Ltd., nitrile content 35%) as NBR, 20 parts by weight of NBR (trade name Nipol DN214, produced by Nippon Zeon Co., Ltd.) having polybutadiene cross-linked with ethyleneglycol dimethacrylate, 3 parts by weight of zinc oxide, 2 parts by weight of stearic acid, 40 parts by weight of calcium carbonate, and 20 parts by weight or more of liquid NBR were mixed by a pressure kneader. 0.5 part by weight of sulfur, 2 parts by weight of vulcanization accelerator (mercaptobenzothiazole), 15 parts by weight of TRA (dipentamethylenethiuram tetrasulfide), 6 parts by weight of ADCA (azodicarbodiamide) serving as a foaming agent, and 3 parts by weight of urea resin as a foaming auxiliary were further mixed by an open roll.

The thus-obtained rubber was molded to a tube by extrusion molding. After extrusion, the tube had no deformation, and exhibited a stable die swell and no dimensional variation in continuous molding. The tube was primarily vulcanized by vapor vulcanization at 160° C. for 30 minutes, and further secondarily vulcanized by an electric furnace at 160° C. for 30 minutes to obtain a vulcanized product. A core bar coated with an adhesive was pressed into the thus-obtained tube, followed by polishing to obtain an elastic roller having a diameter of 16 mm.

Figure 4:
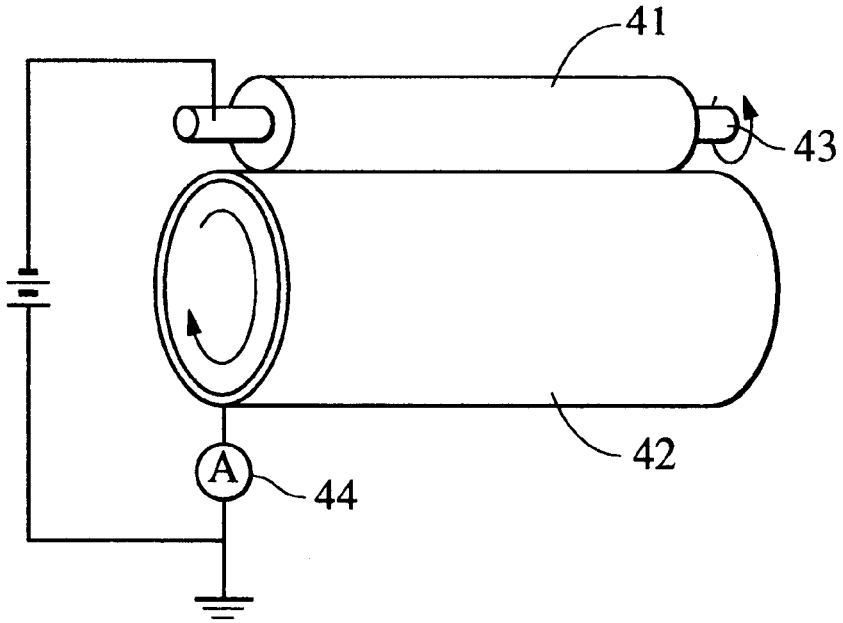
FIG. 4 is a schematic drawing showing the construction of a resistance measuring device for a conductive elastic roller.

The resistance of the elastic roller was measured by using the apparatus including the ampere meter 44 shown in FIG. 4 with a weight of 500 g applied to either end of the conductive core bar 43 of the elastic roller under rotation of an aluminum drum 42. As a result, with a DC voltage of 2 kV applied, the electric resistance value was $1.6\times10^8\Omega$ after the elastic roller was allowed to stand for 24 hours in a N/N atmosphere. The ratio of max./min. during one rotation was 1.1, and hardness was 36° asker C.

An evaluation was made by using the electrophotographic apparatus shown in FIG. 1 comprising the thus-obtained roller as a transfer roller. The process speed was 150 mm/sec., and the photosensitive drum had a diameter of 30 mm. The photosensitive drum comprised an OPC (organic photoconductor) which was negatively charged, the toner used was positively charged, and the voltage applied to the transfer roller was −3 kV during transfer, and +1.5 kV during cleaning.

As a result, a black solid image, and a half tone image by using the transfer roll and dry paper, good images were obtained in any of the environments ranging from L/L (10° C., 15% RH) to H/H (32.5° C., 80% RH). Similarly, as a result of an evaluation of images by double-side transfer using dry paper in the L/L environment, clear images were obtained.

In further evaluation of durability by continuous transfer of 200,000 images, no defect occurred in the images due to variations in the resistance value.

When the transfer roller was brought into pressure contact with the organic photoconductor with a total weight of 1 kg applied, and allowed to stand for 2 weeks in an environment of 40° C. and 95% RH, the problem of sticking did not occur.

Furthermore, the transfer roller was processed by using an ultraviolet irradiation device (wavelength main components including 185 nm and 245 nm) with 40 $mW/cm^2$ for 4 minutes to obtain a roller. When the thus-obtained roller was brought into pressure contact with the organic photoconductor with a total weight of 1 kg applied, and allowed to stand for 30 days in an environment of 40° C. and 95% RH, the problem of sticking did not occur.

As a result of the image evaluation using the roller, no image nonuniformity occurred due to unevenness of the roller.

Next, image evaluation using the photoconductive member in an N/N environment produced good images without a contact mark.

Example 2

A roller was obtained by the same method as in Example 1 except that as elastic materials, 20 parts by weight of EPT4070 (iodine value 22) as EPDM, 40 parts by weight of N240S (trade name, produced by Nippon Synthetic Rubber Co., Ltd., nitrile content 26%) as NBR, 20 parts by weight of NBR (trade name Nipol DN214) having polybutadiene cross-linked with ethyleneglycol diacrylate, 20 parts by weight of epichlorohydrin homopolymer, 3 parts by weight of zinc oxide, 2 parts by weight of stearic acid, 40 parts by weight of calcium carbonate, and 20 parts by weight or more of liquid NRR were mixed by a pressure kneader, and 0.5 part by weight of sulfur, 2 parts by weight of vulcanization accelerator (mercaptobenzothiazole), 1.5 parts by weight of TRA (dipentamethylenethiuram tetrasulfide), 1 part by weight of trimercapto-S-triazine, 6 parts by weight of ADCA (azodicarbodiamide) serving as a foaming agent, and 3 parts by weight of urea resin as a foaming auxiliary were further mixed by an open roll.

After the thus-obtained roller was allowed to stand in an N/N environment for 24 hours, the electric resistance value was $2.1\times10^8\Omega$ with a DC voltage of 2 kV applied. The ratio of max./min. during one rotation was 1.1, and hardness was 30° asker C.

As a result of the evaluation of images by double-side transfer using dry paper in a L/L environment, clear images were obtained.

During the evaluation of durability by continuous transfer of 200,000 images, no defect occurred in the images due to variations in the resistance value. As a result of further evaluation of durability by continuous transfer of 200,000 images (total 400,000 images), no defect occurred in images due to variations in the resistance value.

The other evaluation results were the same as Example 1.

Example 3

A roller was obtained by the same method as in Example 2 except that as elastic materials, 10 parts by weight of BR01 as BR, 30 parts by weight of N240S (nitrile content 26%) as NBR, 30 parts by weight of NBR (trade name Nipol 1411, produced by Nippon Zeon Co., Ltd.) having polybutadiene partially cross-linked with trivinyl benzene, and 30 parts by weight of epichlorohydrin homopolymer were used.

After the thus-obtained roller was allowed to stand in an N/N environment for 24 hours, the electric resistance value was $1.4\times10^8\Omega$ with a DC voltage of 2 kV applied. The ratio of max./min. during one rotation was 1.1, and hardness was 30° asker C.

Example 4

A roller was obtained by the same method as in Example 2 except that as elastic materials, 20 parts by weight of EPT4070 as EPDM, 30 parts by weight of N233S (trade name, produced by Nippon Synthetic Rubber Co., Ltd., nitrile content 35%) as NBR, 10 parts by weight of NBR (trade name Nipol 1411) having polybutadiene partially cross-linked with trivinyl benzene, and 40 parts by weight of epichlorohydrin homopolymer were used.

After the thus-obtained roller was allowed to stand in an N/N environment for 24 hours, the electric resistance value was $1.1\times10^8\Omega$ with a DC voltage of 2 kV applied. The ratio of max./min. during one rotation was 1.1, and hardness was 33° asker C.

The other evaluation results were the same as in Example 1.

COMPARATIVE EXAMPLE 1

A roller was obtained by the same method as in Example 1 except that 100 parts by weight of B240S (trade name, produced by Nippon Synthetic Rubber Co., Ltd., nitrile content 26%) was used as NBR.

The obtained tube was decentered due to deformation after extrusion. Also, die swell significantly varied with the extrusion pressure, and continuous molding exhibited significant dimensional variations due to plastizing rubber without stability.

After the resultant roller was allowed to stand in an N/N environment for 24 hours, the electric resistance value was $1.6\times10^8\Omega$ with a DC voltage of 2 kV applied. The ratio of max./min. during one rotation was 1.4, and hardness was 36° asker C.

In the evaluation of durability by continuous transfer of 200,000 images, no defect occurred in the images due to variations in the resistance value.

When the transfer roller was brought into pressure contact with the organic photoconductor with a total weight of 1 kg applied, and allowed to stand for 2 weeks in an environment of 40° C. and 95% RH, sticking occurred.

Furthermore, the transfer roller was processed by using an ultraviolet irradiation device (wavelength main components including 185 nm and 245 nm) with 40 mW/cm$^2$ for 4 minutes to obtain a roller. When the thus-obtained roller was brought into pressure contact with the organic photoconductor with a total weight of 1 kg applied, and allowed to stand for 30 days in an environment of 40° C. and 95% RH, sticking occurred.

As a result of the image evaluation using the roller, image nonuniformity occurred due to unevenness of the roller. The other evaluation results were the same as in Example 1.

COMPARATIVE EXAMPLE 2

A roller was obtained by the same method as in Example 2 except that 40 parts by weight of EPT4070 as EPDM, and 60 parts by weight of copolymer of epichlorohydrin and ethylene oxide were used. Die swell signficantly varied with the extrusion pressure, and continuous molding exhibited significant dimensional variations due to plastizing rubber without stability.

After the resultant roller was allowed to stand in an N/N environment for 24 hours, the electric resistance value was $9\times10^7\Omega$ with a DC voltage of 2 kV applied. The ratio of max./min. during one rotation was 1.3, and hardness was 35° asker C.

As a result of the evaluation of durability by continuous transfer of 200,000 images, the resistance was increased. Particularly, in an evaluation of images by double side transfer using dry paper in a L/L environment, spatters occurred.

When the transfer roller was brought into pressure contact with the organic photoconductor with a total weight of 1 kg applied, and allowed to stand for 2 weeks in an environment of 40° C. and 95% RH, sticking occurred.

Furthermore, the transfer roller was processed by using an ultraviolet irradiation device (wavelength main components including 185 nm and 245 nm) with 40 mW/cm$^2$ for 4 minutes to obtain a roller. When the thus-obtained roller was brought into pressure contact with the organic photoconductor with a total weight of 1 kg applied, and allowed to stand for 30 days in an environment of 40° C. and 95% RH, sticking occurred. As a result of image evaluation using the roller, image nonuniformity occurred due to unevenness of the roller.

The other evaluation results were the same as in Example 2.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A charging member to which a voltage is applied, said member comprising a conductive elastomer comprising a vulcanized rubber composition containing a first nitrile rubber having a cross-linked polybutadiene structure in its molecule and a second nitrile rubber having a nitrile content of 15 to 45% by weight.

2. A charging member according to claim 1, wherein the cross-linked polybutadiene structure is obtained by cross-linking polybutadiene with a polyfunctional monomer.

3. A charging member according to claim 2, wherein the polyfunctional monomer is a monomer selected from ethyleneglycol dimethacrylate and trivinyl benzene.

4. A charging member according to claim 1, wherein the rubber composition comprises 10 to 50 parts by weight of the first nitrile rubber having the cross-linked polybutadiene structure in its molecule, 20 to 70 parts by weight of the second nitrile rubber, and 10 to 50 parts by weight of nonpolar polymer.

5. A charging member according to claim 4, wherein the nonpolar polymer is EPDM (ethylene propylene diene terpolymer).

6. A charging member according to claim 5, wherein EPDM has an iodine value of 20 or more.

7. A charging member according to claim 4, wherein the rubber composition further comprises 10 to 40 parts by weight of epichlorohydrin homopolymer.

8. A charging member according to claim 1, wherein after vulcanization, the surface of the rubber composition is irradiated with ultraviolet rays.

9. A charging member according to claim 1, wherein an elastic layer formed by vulcanizing the rubber composition has a volume resistance value of $1\times10^5$ to $1\times10^{12}\Omega$.

10. A charging member according to claim 1, wherein an elastic layer formed by vulcanizing the rubber composition has a hardness of 20 to 80° (asker C).

11. An image-forming apparatus comprising a charging member of any one of claims 1 to 10.

12. An image forming apparatus according to claim 11, wherein the charging member comprises a transfer roller.

13. A process cartridge comprising at least one of development means and cleaning means, which is integrated with a photosensitive member and a charging member to form a cartridge detachable from a body of an image forming apparatus, wherein the charging member is a charging member according to any one of claims 1 to 10.

* * * * *

UNITED STATES PATENT AND TRADEMARK OFFICE

CERTIFICATE OF CORRECTION

PATENT NO. : 6,243,552 B1
DATED : June 5, 2001
INVENTOR(S) : Jun Murata

It is certified that error appears in the above-identified patent and that said Letters Patent is hereby corrected as shown below:

Title page,
Item [56], References Cited, U.S PATENT DOCUMENTS, "5,742,860 *" should read -- 5,742,880* --.

Column 1,
Line 16, "graphlc" should read -- graphic --.

Column 2,
Line 30, "return" should read -- returned --.

Column 4,
Line 58, "because" should read -- is because --; and
Line 59, "that" should read -- so that --.

Column 6,
Line 49, "electrostaic" should read -- electrostatic --.

Column 7,
Line 8, "the as" should read -- as the --.

Column 11,
Line 5, "plastizing" should read -- plasticizing --; and
Line 38, "plastizing" should read -- plasticizing --.

Signed and Sealed this

Twenty-sixth Day of March, 2002

*Attest:*

*Attesting Officer*

JAMES E. ROGAN
*Director of the United States Patent and Trademark Office*